US005108327A

United States Patent [19]

Klein

[11] Patent Number: 5,108,327

[45] Date of Patent: * Apr. 28, 1992

[54] RETRACTABLE SWIM FIN

[76] Inventor: Kevin R. Klein, 73 Jasper St., Dayton, Ohio 45409

[ * ] Notice: The portion of the term of this patent subsequent to Jan. 1, 2008 has been disclaimed.

[21] Appl. No.: 636,493

[22] Filed: Dec. 31, 1990

Related U.S. Application Data

[63] Continuation of Ser. No. 304,551, Feb. 1. 1989, Pat. No. 4,981,454.

[51] Int. Cl.[5] ..... A63B 31/11

[52] U.S. Cl. ..... 441/62; 441/63; 441/64

[58] Field of Search ..... 441/61-64

[56] References Cited

U.S. PATENT DOCUMENTS

| | | | |
|---|---|---|---|
| 2,729,832 | 1/1956 | Schmitz | 441/64 |
| 2,903,719 | 9/1959 | Wozencraft | 441/64 |
| 3,082,442 | 3/1963 | Cousteau | 441/64 |
| 3,171,142 | 3/1965 | Auzols | 441/63 |
| 3,268,927 | 8/1966 | Markowitz | 441/63 |
| 3,302,223 | 2/1967 | Ciccotelli | 441/64 |
| 3,665,535 | 5/1972 | Picken | 441/64 |
| 4,025,977 | 5/1977 | Cronin | 441/64 |
| 4,209,866 | 7/1980 | Loeffler | 441/64 |
| 4,250,584 | 2/1981 | Korn | 441/64 |
| 4,657,515 | 4/1987 | Ciccotelli | 441/64 |
| 4,689,029 | 8/1987 | Ciccotelli | 441/64 |
| 4,752,259 | 6/1988 | Tackett et al. | 441/64 |

FOREIGN PATENT DOCUMENTS

| | | | |
|---|---|---|---|
| 2565498 | 12/1985 | France | 441/64 |
| 533240 | 9/1955 | Italy | 441/62 |
| 1189460 | 11/1985 | U.S.S.R. | 441/64 |

*Primary Examiner*—Sherman Basinger
*Attorney, Agent, or Firm*—Jacox & Meckstroth

[57] ABSTRACT

Improved swimming efficiency and safety in a water environment is achieved with the use of retractable swim fins having a web-like member rotatably interconnected to a shoe-like member. A latch includes a latch element which secures the web-like member to the shoe-like member in a downward swimming position. The latch element is released by linear pressure from the other foot to permit the web-like member to rotate in response to a spring force to an upward walking position. A natural swimming kick returns and latches the web-like member to the swimming position.

11 Claims, 1 Drawing Sheet

20
32
44
34
32
12
36
34
22
24
28
26
10
14

16
20
32
12
18
44
10
24
30
36
14

14
10
4
44
4
16
42
5
20
32
18
12
38
24
30
36
34
5

44
42
42
14
46
48
46
40
40

12
32
32
28
26
38
38
30
26
24
30
24
28
34
36
34
10

RETRACTABLE SWIM FIN

RELATED APPLICATION

This application is a continuation of application Ser. No. 304,551, filed Feb. 1, 1989 and now U.S. Pat. No. 4,981,454.

BACKGROUND OF THE INVENTION

1. Field of the Invention

The present invention generally relates to a swim fin. More particularly, the present invention relates to a retractable swim fin which increases swimming efficiency and which, when retracted, increases walking efficiency.

2. Description of the Prior Art

In accordance with the prior art a swim fin may be defined as an area expanding appendage which, when attached to a foot of a swimmer, enables the swimmer to generate more propulsive force through water. For optimum benefit, a swim fin generally has from 5 to 50 times the area of the swimmer's foot.

Various swim fin arrangements have been proposed and utilized to generally provide a more efficient swim fin. Representative of the prior art are the swim fin and swim shoe arrangements disclosed in U.S. Pat. Nos. 2,729,832 (Schmitz), 2,903,719 (Wozencraft), 2,980,926 (Wolshin), 3,082,442 (Cousteau), 3,171,142 (Auzols), 3,268,927 (Markowitz), 3,302,223 (Ciccotelli), 3,665,535 (Picken), 4,025,977 (Cronin), 4,209,866 (Loeffler), 4,250,584 (Korn), 4,657,515 (Ciccotelli), and 4,689,029 (Ciccotelli).

The patents issued to Schmitz, Auzols, Picken, Cronin, Loeffler, and Ciccotelli generally involve the angular orientation of a fin relative to the plane of a foot or the longitudinal axis of a lower leg of a swim fin user. While the patents issued to Wolshin and Markowitz generally involve footgear with a swim fin disposable either in a walking position or a swimming position. The patent issued to Cousteau generally involves a swim fin comprising a footgear section, a propelling section, and an interconnecting section having less rigidity than the footgear and propelling sections; whereas the patent issued to Korn generally involves a collapsible swim fin. And lastly, the patent issued to Wozencraft generally involves a forwardly projecting swim fin hingedly connected to a swim shoe so that the swim fin may be swung rearwardly of the swimmer's foot. Basically, most of the cited swim fin arrangements comprise a propelling section angularly oriented with respect to the plane of a foot or the longitudinal axis of a lower leg of a swim fin user and a footgear section integral with the propelling section.

SUMMARY OF THE INVENTION

As indicated above, a swim fin generally has from 5 to 50 times the area of the swimmer's foot. While this large area, protruding as a fan-shaped extension similar to a duck's foot, is extremely helpful for propelling the swimmer in water, such extension is extremely awkward and even dangerous when the swimmer attempts to walk with the swim fins in place.

The angular projection of a swim fin from a swimmer's leg required for optimum swimming efficiency causes an imbalance of the natural standing posture of a swim fin wearer. Additionally, the large protruding fin area in front of each foot tends to strike and become caught in all manner of objects near the feet. And worst of all, the large fin protrusion on one foot tends to be stepped upon by the other foot when walking is attempted, pitching the swim fin wearer forward and preventing the quick-foot response which usually prevents loss of balance.

Falls are particularly troublesome and dangerous when aboard moving boats or on narrow docks where the probability of falling int the water is great. This undesirable situation is often acerbated when a swimmer is wearing heavy gear, for example, scuba gear, where falling can cause serious injury or even death by drowning if the scuba gear is partially disassembled at the time of a fall into water. Furthermore, large protruding swim fins can be a major hindrance when a swim fin wearer walks on any underwater surface because the swim fins tend to stir-up sediment on the bottom. This can make it difficult for the swim fin wearer to see sharp objects or to avoid dangerous sea life.

In accordance with the teachings of the present invention a retractable swim fin is provided which comprises a shoe-like member or boot with a foot receivable pocket adapted for attaching the retractable swim fin to a foot of a swimmer's lower leg. A web for providing propulsive thrust in a water environment is hingedly or pivotally connected to the shoe-like member or boot. Conventional latching means secures the web to the shoe-like member or boot in a downward swimming position. Latch releasing means permits the web to pivot to an upward walking position parallelly adjacent to the front side of a leg of the swimmer. In this upward position the wearer can stand or walk easily and safely. A quick kick by the wearer's foot underwater returns and latches the web into the conventional downward position for further swimming activities.

The above and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

For a further understanding of the nature and object of the invention, reference should be had to the detailed description of the exemplary embodiment taken in connection with the appended drawings in which.

DESCRIPTION OF THE PREFERRED EMBODIMENT

Figure 1:
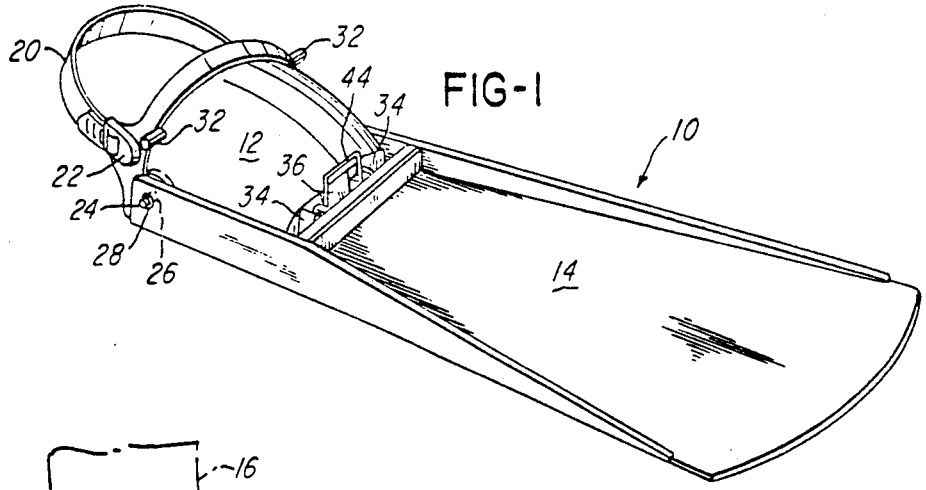
FIG. 1 is a perspective view of a retractable swim fin embodying the features of the present invention.

In the following description, like reference characters designate like or corresponding parts throughout the several views of the drawings. Also in the following description, it is to be understood that such terms as "forward", "rearward", "left", "right", "upwardly", "downwardly", and the like, are words of convenience and are not to be construed as limiting terms.

Figure 2:
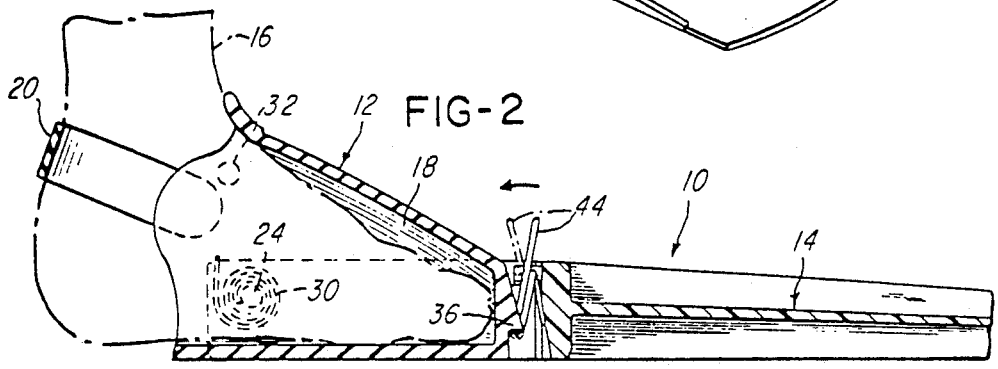
FIG. 2 is a partial side view of the retractable swim fin of the present invention (illustrated in the swimming mode) with portions thereof broken away.

Referring now to the drawings, and particularly to FIGS. 1 and 2, there is illustrated a retractable swim fin, generally designated by the numeral 10 and constituting the preferred embodiment of the present invention. In its basic components, retractable swim fin 10 includes a shoe-like member 12 and a web-like member 14. Web-like member 14 is pivotally and springingly interconnected to shoe-like member 12, which is more fully described below.

Retractable swim fin 10 is securable to a lower leg at a swimmer's foot 16 by means of a shoe-like member 12 which comprises a foot receiving pocket 18 to accommodate the forward portion of swimmer's foot and 16 and an adjustable strap 20 which fits around the rearward portion of swimmer's foot 16 at an ankle. Adjustable strap 20 is pivotally attached to a foot receiving pocket 18 by a pair of diametrically opposed buckles 22 which allow adjustable strap 20 to be tightened or loosened about a swimmer's foot 16, as required, so that adjustable strap 20 in conjunction with foot receiving pocket 18 secures retractable swim fin 10 to swimmer's foot 16.

As indicated above, web-like member 14 is pivotally and springingly interconnected to shoe-like member 12. This is accomplished by having a pair of diametrically opposed pivot pins 24, which are affixed to shoe-like member 12 in a downward and rearward location of shoe-like member 12, project through holes 26 in web-like member 14 in a rearward location of web-like member 14, and by fastening web-like member 14 to shoe-like member 12 by means of a pair of releasable fasteners 28. Interposed between shoe-like member 12 and web-like member 14 are a pair of diametrically opposed spiral springs 30 which interconnect shoe-like member 12 and web-like member 14 so that the tension of coil springs 30 causes web-like member 14 to pivot on pivot pins 24 and rotate toward the front of a swimmer's lower leg. However, the rotation of web-like member 14 is stopped before web-like member 14 contacts the front of a swimmer's lower leg by a pair of diametrically opposed stop pins 32 which are affixed to shoe-like member 12. Although the footgear section hereinabove described comprises a shoe-like member 12 with foot receiving pocket 18 and adjustable strap 20, in another embodiment of the present invention shoe-like member 12 would be a boot or the like.

Figure 3:
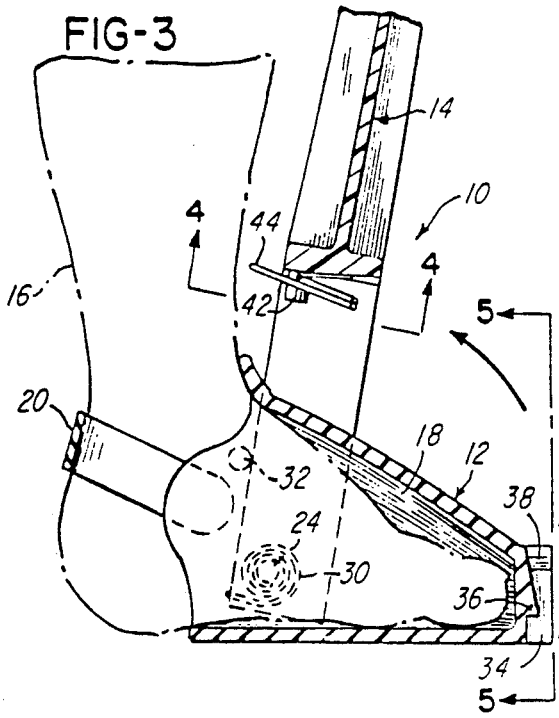
FIG. 3 is a partial side view of the retractable swim fin of the present invention (illustrated in the walking mode) with portions thereof broken away.
Figure 5:
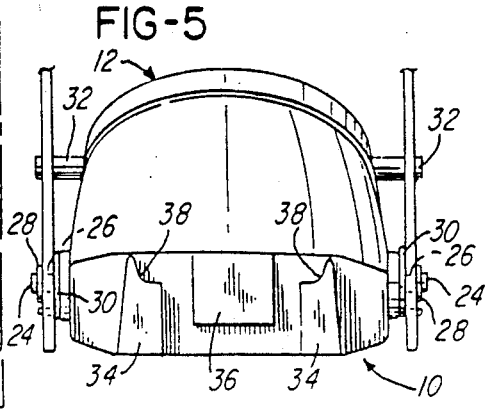
FIG. 5 is a fragmentary view of the retractable swim fin of the present invention as seen along line 5—5 of FIG. 3.

Referring now again to the drawings, and particularly to FIGS. 3 and 5, there is illustrated a pair of guideway-stops 34 and an interposed catch 36 integral to shoe-like member 12 in a location forward of foot receiving pocket 18, with both, the pair of guideway-stops 34 and catch 36, being aligned perpendicular to the bottom side of shoe-like member 12. Guideway-stops 34 are generally trapezoidal-shaped, each having an upper portion of an inner vertical side and a top horizontal side define an arcuate segment 38, while an outer vertical side forms with an inner vertical side a configuration that is somewhat narrower at a top horizontal side than at a bottom horizontal side. Such trapezoidal shape of guideway-stops 34 provides a means of aligning web-like member 14 with respect to shoe-like member 12.

Located rearwardly at the backside of web-like member 14 are a pair of guideway pins 40 and a pair of guideway-stop pins 42. Guideway pins 40 and guideway-stop pins 42 are positioned on the backside of web-like member 14 so that each guideway pin 40 is aligned toward the outward side of a guideway-stop 34 while each guideway-stop pin 42 is directly aligned with an arcuate segment 38. Whenever web-like member 14 revolves away from the front of a swimmer's lower leg, each guideway pin 40 eventually contacts an outward side of a guideway-stop 34. Simultaneously, each guideway-stop pin 42 contacts an arcuate segment 38 preventing web-like member 14 from further rotation. Thus, whenever web-like member 14 is at an attitude substantially parallel to the general axial direction of a swimmer's foot, there is minimal lateral or torsional movement of web-like member 14 with respect to shoe-like member 12.

As indicated above interposed between a pair of guideway-stops 34 is catch 36 integral to shoe-like member 12 in a location forward of foot receiving pocket 18, with both, the pair of guideway-stops 34 and catch 36, being aligned perpendicular to the bottom side of shoe-like member 12. Catch 36, which is part of a latching-releasing mechanism, is an inclined plane with its lower portion abutting outwardly from the forward side of foot receiving pocket 18 and forming a shoulder with respect to the forward side of foot receiving pocket 18.

Figure 4:
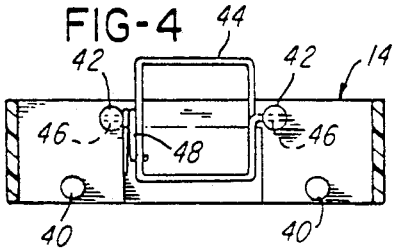
FIG. 4 is a fragmentary view of the retractable swim fin of the present invention as seen along line 4—4 of FIG. 3.

Referring yet again to the drawings, and particularly to FIGS. 2, 3, and 4, there is illustrated a latchkey 44 which in conjunction with catch 36 constitute the basic components of a latching-releasing mechanism. Latchkey 44 which generally defines the shape of a rectangle is constructed from a continuous rod with both rod endpieces outwardly and perpendicularly oriented with respect to the two vertical parallel sides of latchkey 44 and with both rod endpieces located at approximately the midpoint of the two vertical parallel sides of latchkey 44. (Any overlapping rod segment of latchkey 44 is affixed together.) Each rod endpiece of latchkey 44 is rotatably positioned in an opening 46 in guideway-stop pins 42, which are positioned on the backside of web-like member 14, so as to allow latchkey 44 freedom of rotational movement. The upper portion of latchkey 44 is exposed above the upper plane of web-like member 14. A latchkey spring 48 located at the backside of web-like member 14 causes the upper portion of latchkey 44 to rotate away from the swimmer's foot 16 and causes the bottom portion of latchkey 44 to rotate toward the front of swimmer's foot 16. The upper portion of latchkey 44 is stopped in its rotational movement by the backside of web-like member 14.

As can be seen from the above detailed description when taken in conjunction with the drawings, retractable swim fin 10 of the present invention can be secured to a swimmer's foot 16 with web-like member 14 either at an attitude substantially parallel to or perpendicular to the general axial direction of a swimmer's lower leg. Whenever a user of retractable swim fin 10 is walking, whether out of water or under water, efficiency and safety is increased when web-like member 14 is retracted. And when web-like member 14 is retracted, a user of retractable swim fin 10 can use a rapid kick motion to rotate web-like member 14 forwardly until latchkey 44 first contacts the inclined plane and then engages the shoulder of catch 36. When web-like member 14 is in the swimming position, not retracted, a user of retractable swim fin 10 can cause web-like member 14 to be released from catch 36 by exerting backward pressure from the heel of the other foot onto the exposed portion of latchkey 44.

It is thought that the present invention and many of its attendant advantages will be understood from the foregoing description and it will be apparent that various changes may be made in the form, construction, and arrangement of the parts thereof without departing from the spirit and scope of the invention or sacrificing all of its material advantages, the form hereinabove described being merely an exemplary embodiment thereof.

I claim:

1. A retractable swim fin comprising a shoe-like member having a foot receiving pocket and means for attachment to a swimmer's foot, a retractable web-like member for providing forward propulsive thrust in a water environment, means for pivotally connecting said web-like member to said shoe-like member for pivotal movement of said web-like member between a retracted position and a swimming position, said web-like member in said retracted position projecting upwardly generally parallel to and adjacent the swimmer's leg, said web-like member in said swimming position projecting forwardly generally perpendicular to the leg, a latch including a latch element supported for movement between a released position and a locked position for positively locking said web-like member to said shoe-like like member in said swimming position, said latch element including a heel engaging portion projecting outwardly from said web-like member in said locked position of said latch element, and said latch element being movable to said released position in response to engagement and pressure by the heel of the swimmer's other foot to allow movement of said web-like member from said swimming position to said retracted position without requiring the use of the swimmer's hand.

2. A retractable swim fin as defined in claim 1 wherein said latch element is supported for pivotal movement by said web-like member and on an axis extending generally parallel to the pivot axis of said means for pivotally connecting said web-like and shoe-like members.

3. A rectractable swim fin as defined in claim 2 and including a coil spring adjacent said latch element for biasing said latch element towards said locked position securing said web-like member to said shoe-like member.

4. A retractable swim fin as defined in claim 1 wherein said latch element is moved to a released position in response to movement of said heel engaging portion of said latch element towards said shoe-like member.

5. A retractable swim fin as defined in claim 1 and including a coil spring adjacent said pivotally connecting means for biasing said web-like member from said swimming position to said retracted position.

6. A rectractable swim fin comprising a shoe-like member having a foot receiving pocket and means for attachment to a swimmer's foot, a retractable web-like member for providing forward propulsive thrust in a water environment, means for pivotally connecting said web-like member to said shoe-like member for pivotal movement of said web-like member between a retracted position and a swimming position, said web-like member in said retracted position projecting upwardly generally parallel to and adjacent the swimmer's leg, said web-like member in said swimming position projecting forwardly generally perpendicular to the leg, spring means for biasing said web-like member from said swimming position to said retracted position, a latch including a latch element supported for movement between a released position and a locked position for positively locking said web-like member to said shoe-like member in said swimming position, said latch element including a heel engaging portion projecting outwardly from said web-like member in said locked position of said latch element, and said latch element being movable to said released position in response to engagement and pressure by the heel of the swimmer's other foot to allow movement of said web-like member from said swimming position to said retracted position without requiring the use of the swimmer's hand.

7. A retractable swim fin as defined in claim 6 wherein said spring means comprise a coil spring disposed adjacent said pivotally connecting means.

8. A retractable swim fin as defined in claim 6 wherein said heel engaging portion comprises an inverted U-shaped portion projecting upwardly above said shoe-like member, and means supporting said latch element for pivotal movement on an axis extending generally parallel to the pivot axis of said means for pivotally connecting said web-like and shoe-like members.

9. A retractable swim fin as defined in claim 8 wherein said U-shaped portion of said latch element moves towards said shoe-like member to said released position.

10. A retractable swim fin as defined in claim 6 and including a coil spring adjacent said latch element for biasing said latch element towards a locked position securing said web-like member to said shoe-like member.

11. A retractable swim fin comprising a shoe-like member having a foot receiving pocket and means for attachment to a swimmer's foot, a retractable web-like member for providing forward propulsive thrust in a water environment, means for pivotally connecting said web-like member to said shoe-like member for pivotal movement of said web-like member between a retracted position and a swimming position, said web-like member in said retracted position projecting upwardly generally parallel to and adjacent the swimmer's leg, said web-like member in said swimming position projecting forwardly generally perpendicular to the leg, a latch including a latch element supported for movement between a released position and a locked position for positively locking said web-like member to said shoe-like member in said swimming position, said latch element including an inverted U-shaped heel engaging portion projecting upwardly from said web-like member in said locked position of said latch element, and said latch element being pivotal to said released position in response to engagement and pressure by the heel of the swimmer's other foot to allow movement of said web-like member from said swimming position to said retracted position without requiring the use of the swimmer's hand.

* * * * *